United States Patent [19]

Kageyama et al.

[11] Patent Number: 5,073,945

[45] Date of Patent: Dec. 17, 1991

[54] LOUDSPEAKER SYSTEM

[75] Inventors: Satoshi Kageyama, Takatsuki; Suemei Fukuhara, Hirakata, both of Japan

[73] Assignee: Matsushita Electric Industrial Co., Ltd., Kadoma, Japan

[21] Appl. No.: 556,073

[22] Filed: Jul. 23, 1990

[30] Foreign Application Priority Data

| | | | |
|---|---|---|---|
| Jul. 24, 1989 | [JP] | Japan | 1-190989 |
| Jul. 24, 1989 | [JP] | Japan | 1-190990 |
| Jul. 24, 1989 | [JP] | Japan | 1-190993 |
| Aug. 4, 1989 | [JP] | Japan | 1-203253 |

[51] Int. Cl.[5] ..... H04R 1/24; H04R 1/28

[52] U.S. Cl. ..... 381/89; 381/158; 381/159; 381/184; 381/186

[58] Field of Search ..... 381/158, 159, 155, 154, 381/153, 150, 182, 184, 186, 89

[56] References Cited

U.S. PATENT DOCUMENTS

| | | | |
|---|---|---|---|
| 4,146,7444 | 3/1979 | Veranth | 381/89 |
| 1,969,704 | 8/1964 | D'Alton | 381/159 |
| 4,783,820 | 11/1988 | Lyngdorf et al. | 381/89 |
| 4,799,264 | 1/1989 | Plummer | 381/158 |
| 4,805,221 | 2/1989 | Quaas | 381/159 |
| 4,987,601 | 1/1991 | Goto | 381/159 |

FOREIGN PATENT DOCUMENTS

| | | | |
|---|---|---|---|
| 0013323 | 1/1979 | Japan | 381/89 |
| 0057095 | 2/1990 | Japan | 381/159 |

OTHER PUBLICATIONS

R. J. Newman, "Dipole Radiator Systems", J. Audio Eng. Soc., vol. 28 pp. 35-39, (1980 Jan.Feb.).

*Primary Examiner*—James L. Dwyer
*Assistant Examiner*—Huyen D. Le
*Attorney, Agent, or Firm*—Cushman, Darby & Cushman

[57] ABSTRACT

An improved dipole type characteristic loudspeaker system has a pair of loudspeakers (1 and 2) which are mounted on the front baffle board (4) and the back baffle board (5) of a console (3) and are connected to be driven in each-other opposite phase relation and have substantially the same acoustic characteristics in the medium and high frequency range but different acoustic characteristic in low frequency range; such loudspeaker system produces good surround-sound effect when used as back loudspeakers only with small number.

10 Claims, 10 Drawing Sheets

LOUDSPEAKER SYSTEM

FIELD OF THE INVENTION AND RELATED ART STATEMENT

1. Field of the Invention

The present invention relates generally to a loudspeaker system, and more particularly to a loudspeaker system having dipole directivity.

2. Description of the Related Art

Recently, as result of development of video image reproducing technology, it becomes possible to see a large screen video image even in home. Accompanying thereto, its sound system are required to have very good and powerful sound to correspond to the large sized vivid video image. Basing on such background situation, as the sound reproducing system to be combined with the home use large sized video image reproducer 12, often is used a surround sound reproducing system, which comprises two or three loudspeaker systems 15, 15, 15 in front of the listener 17, two or more loudspeaker systems 10, 10, . . . in both lateral sides and in back side of him to give surround sound to him. In such surround sound reproducing apparatus, the front side loudspeaker systems are fed with music sound or back ground music or the like main software to be reproduced, and the loudspeaker systems on both lateral sides and the back side are fed with signals which are made by treating the sound signal for the front loudspeaker systems with a special signal treating apparatus so as to make in direct sound or echo sounds.

If the main software sounds directly from the front loudspeaker systems and the treated sounds coming from the lateral sides and/or back side loudspeaker systems would have much different tunes, the listener would have a sense of incongruity. Accordingly the loudspeaker systems to be used for the front parts and the back side parts should be preferably of the same or analogous sound characteristics. That is, even the loudspeaker system to be disposed back side should preferably reproduce the sound ranging up to considerably low frequencies. Furthermore, the back side channels are used to reproduce the indirect sound or echo sound, and therefore, it is desirable that the back side speaker systems should be arranged so that the listener does not feel the existence of particular sound sources at particular points in his back side area. In order to attain the above, there have been a conventional way of disposing the back side loudspeaker systems as shown in FIG. 16, wherein many loudspeaker systems 10, 10, 10 . . . of ordinary type are disposed to surround the listener so that the reproduced sound is as if coming from a continuous sound source which is distributed continuously around the lateral sides and back side of him. However, on the other hand, due to limits of the space or configuration of the room, as well as cost, it is desirable that preferably a small number of the back side loudspeaker systems are used to attain the same and best effect of the surrounding audio sound to the listener.

On the other hand, it is known that a loudspeaker system having directivity of dipole type is useful for some kind of usage, because its directivity shows maximums in the front part and in the back part showing maximum sound pressures in the front part and back part, and shows minimums on both lateral side positions showing minimum sound pressures there (namely, dipole directivity), although the dipole type loudspeaker system has demerit in sharp decrease of sound in low frequency sound reproduction due to sharp decrease of sound pressure level by cancelling of the sound pressures on the front part and the back part of the loudspeaker. The sharp decrease arises in the frequency range lower than a frequency (fc: cut-off frequency attributable to cancelling of opposite phase sound wave) which corresponds to the frequency of the wavelength of width of shorter side or edge of the baffle board. This is disclosed, for instance in DIPOLE RADIATOR SYSTEMS (R. J. Newman, JOURNAL OF THE AUDIO ENGINEERING SOCIETY, 1980, January/-February, VOLUME 28, NUMBER ½).

On the above-mentioned background, the below-mentioned loudspeaker system, which operates equivalently with the above-mentioned dipole type loudspeaker system has been proposed. The above-mentioned proposed system comprises a loudspeaker console having a pair of baffle boards, which are disposed parallel with each other as a front board and a back board of the console and have loudspeakers of each-other equivalent characteristic, and the loudspeakers are driven in opposite phase operation. That is, the manner of the two loudspeakers on the front baffle board and the back baffle board are such that, for instance, when the diaphragm of the loudspeaker on the front baffle board moves outwards of the loudspeaker console, the diaphragm of the other loudspeaker on the back baffle board moves inwards of the loudspeaker console. Such conventional loudspeaker unit shows the dipole directivity such that maximum sound pressures are in front parts of the respective loudspeaker units and minimum sound pressures are in the lateral side parts of the respective loudspeaker units, namely, at the parts of equi-distance from centers of both loudspeaker units.

On the other hand, in the frequency range below the cut-off frequency fc, the sound pressure from both loudspeakers cancel each other even at the parts in front of respective loudspeakers, thereby inducing a sharp decrease of sand pressure level in the frequency range below the cut-off frequency fc.

The cut-off frequency fc of the dipole type loudspeaker system is described as follows:

Provided that a sound propagation distance measured on a straight line from the center of the front loudspeaker unit (fixed on the front baffle board) to the position of a sound measuring device disposed immediately in front of the center of the front loudspeaker unit is $L_1$ and, that a round-about sound propagation distance from the center of the back loudspeaker unit (fixed on the back baffle board) going around the sides of the baffle board to the position of the sound measuring device is $L_2$. Then, the cut-off frequency fc of the sound wavelength $L_c$ given as twice the length of the difference of the above-mentioned distance $L_2-L_1$. (That is $L_c=2(L_2-L_1)$.)

When the above-mentioned dipole type loudspeaker system is used as loudspeaker systems disposed on both lateral back parts, being included in a home type AV (audio-visual) system, the sound pressure of direct sounds from the dipole type loudspeaker system can be made minimum at the position of the listener. And sounds from these dipole loudspeaker systems reflected by the walls, floor and ceiling of the listening room reaches the listener. Therefore, very good surround sound effect is obtainable by using only a small number (one or two) of the loudspeaker system as the lateral back parts.

However, the conventional dipole type loudspeaker system has the cut-off frequency fc, whereunder the sound pressures of the front loudspeaker and the back loudspeaker cancel each other, to sharply decrease the sound level anywhere. Therefore, in order to reproduce a low frequency sound in the surround system, it has been necessary to use a large sized baffle board so that effective distance between the front loudspeaker unit and the back loudspeaker unit are increased in order to lower the cut-off frequency fc. Or alternatively, it has been necessary to use an amplifier which extraordinarily boost the low frequency level of the output signal of the amplifier to be fed to the loudspeaker system. Both the measures of increasing the baffle board size and increasing the low frequency component of the amplifier are not only uneconomical but also impractical for home use.

OBJECT AND SUMMARY OF THE INVENTION

The present invention purports to provide an improved surround sound effect to the listener with limited number of loudspeaker units used.

The above-mentioned object is achieved by a loudspeaker system comprising:

a loudspeaker console having a front baffle board and a back baffle board which are disposed in substantial parallelism to each other, a pair of loudspeakers which are mounted on respective baffle board and operate with substantially the same characteristic with each other above a predetermined frequency but radiate sound of different level under the predetermined frequency level, and a driving circuit for driving the two loudspeakers in each-other opposite phase relation.

By the above-mentioned configuration, in the frequency range which is above the cut-off frequencies the sounds radiated by the front loudspeaker and back loudspeaker are of each-other opposite phase and of equal amplitudes. Therefore, under the cut-off frequencies fc of the console with the two loudspeakers the sound pressure of the loudspeaker is maximum at respective parts in front of the loudspeakers and minimum on the lateral sides of the console. That is the dipole characteristic is produced. Accordingly, only by using a single console which comprises a pair of loudspeakers, satisfactory surround sound effect is obtainable. On the other hand in the frequency range under the cut-off frequency fc, in the one loudspeaker which is connected in series to the high-pass filter the level of the reproduced sound decreases as frequency lowers, the off-setting of the sounds from the front loudspeaker and the back loudspeaker is relieved though the sound wave from the two loudspeakers are of each-other opposite phase. Therefore, the sharp decrease of sound pressure level under the cut-off frequency fc as has been observed in the conventional dipole loudspeaker system is eliminated. Although the dipole directivity becomes lost in the frequency range under the cut-off frequency fc, there is no fear that the surround sound effect is lost, because the human listening ability lose sensitivity to find sound source position for a very low frequency sound.

Instead of using the high frequency filter, other measures to differentiate the frequency characteristic of one loudspeaker at the frequency range below the cut-off frequency fc may be used.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, the present invention is elucidated in detail with reference to preferred embodiments shown in FIG. 1 through FIG. 15.

Figure 1:
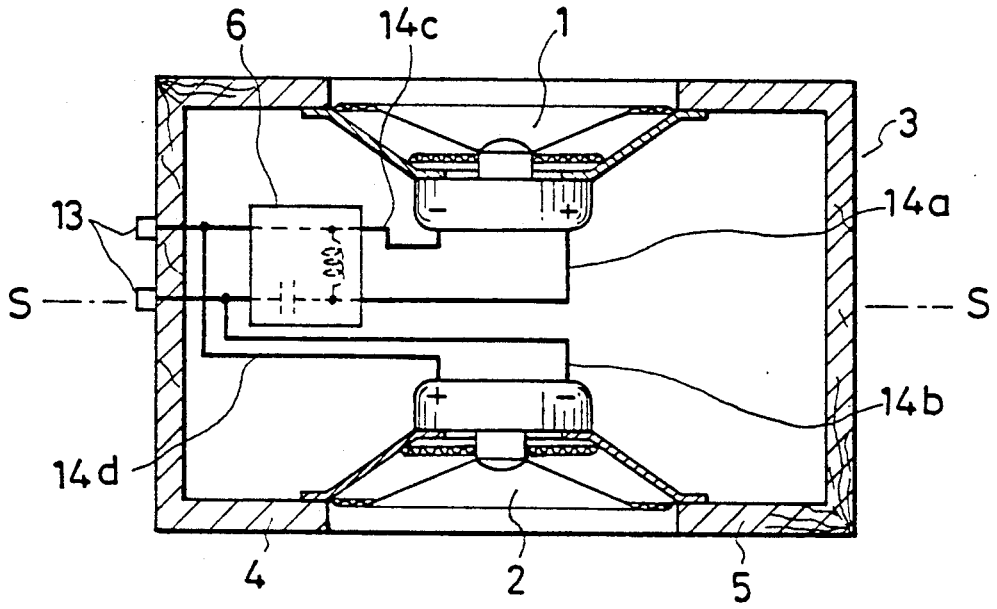
FIG. 1 is a sectional view of a loudspeaker system console of a first embodiment of the present invention.
Figure 2:
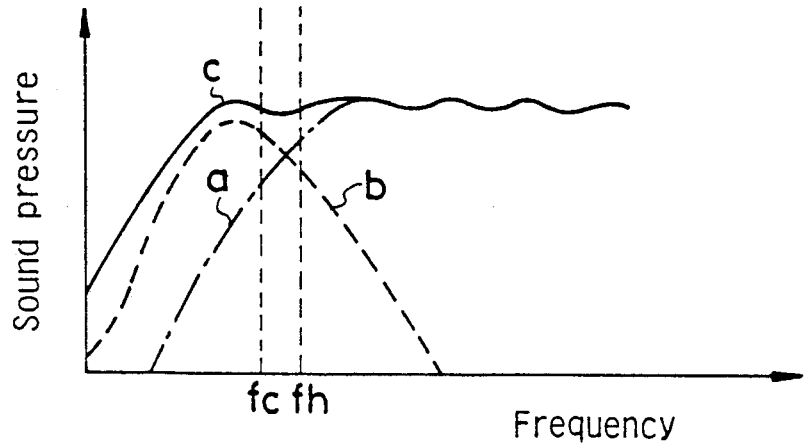
FIG. 2 is a frequency characteristic chart of the loudspeaker system of the first embodiment.

FIRST EMBODIMENT (FIG. 1 and FIG. 2)

In FIG. 1, a pair of loudspeakers 1 and 2 are mounted on respective baffle boards 4 and 5 which constitute both parallel walls of a console 3. The loudspeakers 1 and 2 have substantially equivalent sound and electric characteristics. The pair of loudspeakers 1 and 2 are connected through a high-pass filter 6 and directly to sound signal input terminals 13, respectively. The connections of the loudspeakers 1 and 2 are made by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5. The high-pass filter 6 is designed to have each cut-off frequency fh which is selected, for instance slightly higher than the cut-off frequency fc of the pair of loudspeakers 1 and 2.

According to the above-mentioned configuration, in the medium and high frequency range wherein the electric signal fed to pass through the filter 6 is not influenced by the filter 6, the sound waves radiated from the first loudspeaker and the second loudspeaker are of the same amplitude but opposite phase relation. Therefore, in the medium and high frequency ranges of sound, the loudspeaker system of this console shows a dipole directivity sound pressure characteristic wherein maximum sound pressures are observed in front of each loudspeaker and minimum sound pressures are observed on the positions of equal distances from centers of both loudspeakers 1 and 2, that is on the lateral side positions which are shown by a line S—S. On the other hand, in a low frequency range which is below the cut-off frequency fh of the high-pass filter 6, the first loudspeaker 1 receives filtered input signals through the high-pass filter 6. Therefore, when the first loudspeaker 1 only be operated, it shows an overall characteristic as shown by curve "a" of FIG. 2 when an electric signal of flat spectrum is applied to through the input terminal 13 and the sound pressure is measured at the position immediately in front of the diaphragm of the first loudspeaker 1. As shown in FIG. 2, the curve "a" falls down in the frequency range below fh. When the second loudspeaker 2 only be operated, it shows a frequency characteristic as shown by the curve "b" of FIG. 2 against a measuring point which is immediately in front of the first loudspeaker 1, because sound components of middle frequency range and high frequency range are decreased by going around of the sound wave from the second loudspeaker 2 to the measuring position immediately in front of the first loudspeaker 1. Thus, the loudspeakers 1 and 2 make sounds of different sound level characteristics, that is, they have different amplitude of the sound waves at the position in front of the first loudspeaker 1. And hence cancelling of the sound pressure is not completely made. Therefore, overall sound pressure frequency characteristic of the console with two loudspeakers 1 and 2, when both are driven in the opposite phase relation and measured at a position in front of the first loudspeaker, becomes to extend below the cut-off frequency fc as shown by curve "c" in FIG. 2. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2 of substantially the same electric and acoustic characteristic, a pair of multi-way loudspeaker systems may be used, wherein each multi-way loudspeaker system has plural unit loudspeaker and suitable dividing network.

Figure 15:
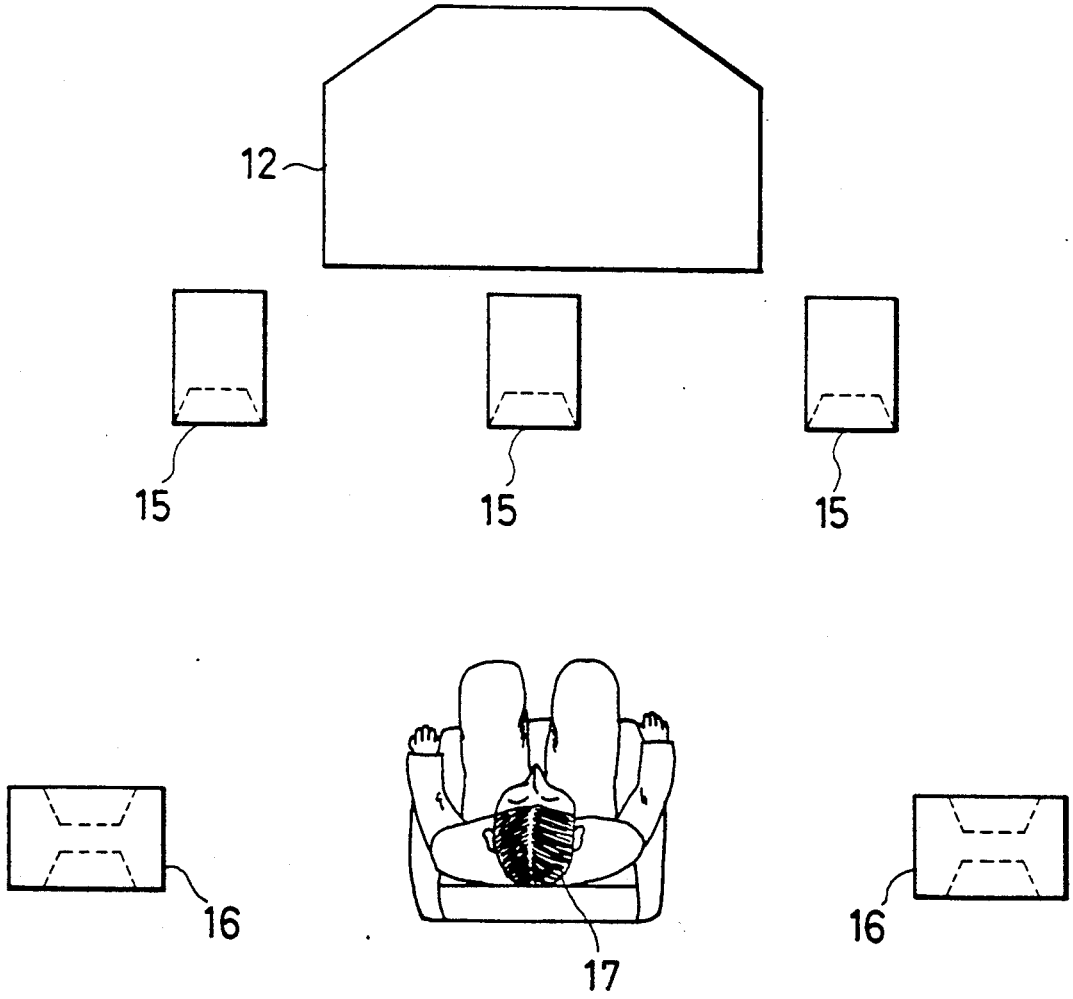
FIG. 15 is a schematic plan view showing one example of disposition of audio reproduction apparatus of a home use AV reproduction system using the loudspeaker console embodying the present invention as back loudspeaker systems.
Figure 16:
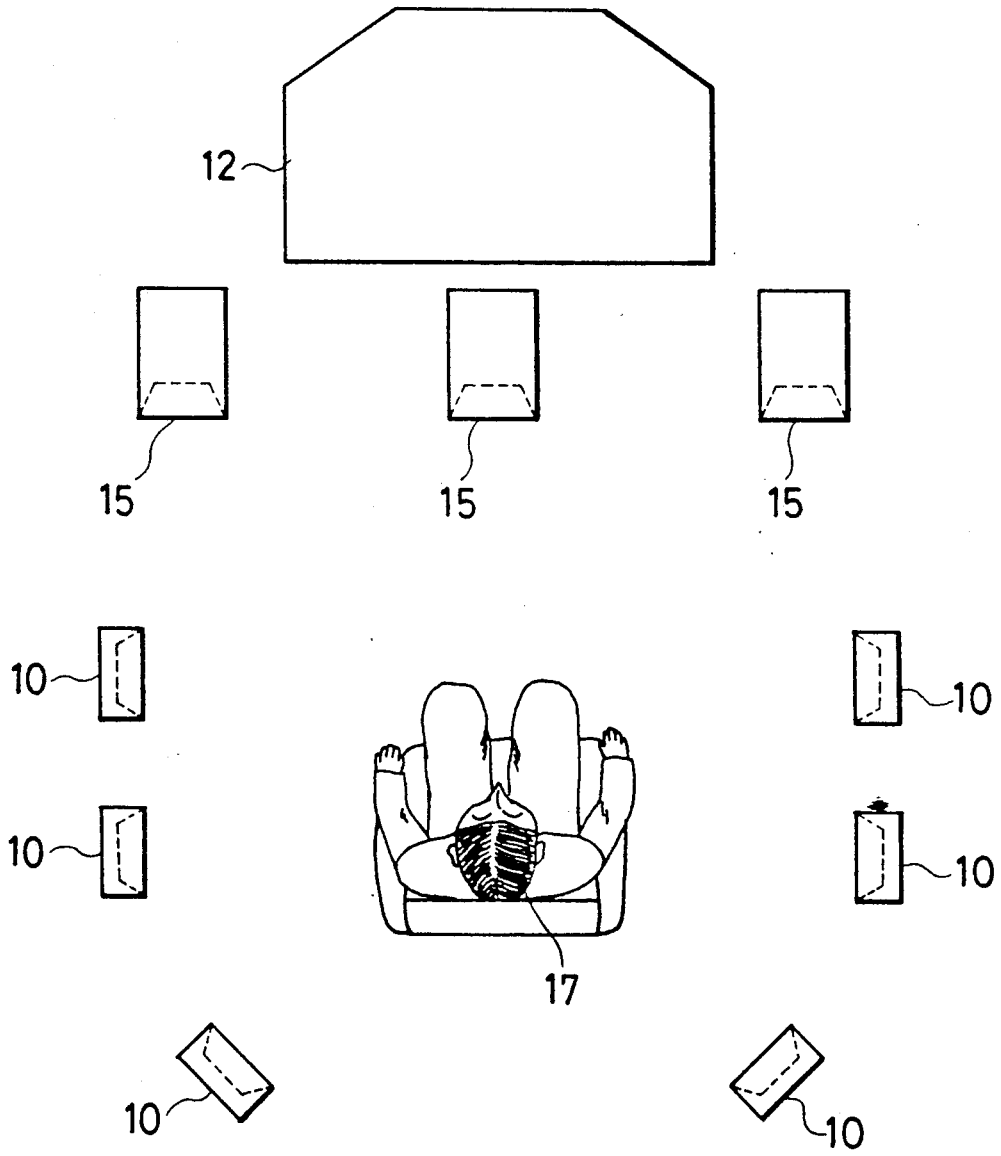
FIG.16 (Prior Art)
FIG. 16 is a schematic plan view of a prior art showing one example of disposition of sound reproduction system combined with a home use AV reproduction system using conventional loudspeaker systems as back and side loudspeaker systems.

FIG. 15 is a plan view showing one example of disposition of an AV reproducing system, wherein a home use image reproduction apparatus 18, front part loudspeaker systems 15, 15, 15 and the console or loudspeaker systems 16, 16 of the embodiment in accordance with the present invention are combined. Therein a pair of consoles 16, 16 are disposed as the back loudspeaker systems on both (left and right) sides of the listener 17. The directivity characteristic of each back loudspeaker console 16 is, with respect to frequency range above the cut-off frequency fh of the high-pass filter 6, is a dipole directivity. Therefore, around at the position of the listener 17, the sound pressure of direct sound from the back loudspeaker console 16 is minimum for the frequencies above the cut-off frequency fh, and only the indirect sound reflected by the walls of the listening room reaches the ears of the listener. Thus, sufficient surround sound effect for the listener 17 is obtainable. Although the dipole directivity is lost as the frequency lowers, the surround sound effect is not substantially lost since the human listening sensitivity has poor direction/position finding ability for the low frequency sound. Rather, the configuration of the present invention using only small number of back loudspeaker consoles can achieve satisfactory surround sound effect comparable with the prior art configuration which uses many back and side loudspeakers, since the sound qualities of the back loudspeaker consoles 16, 16 can be made considerably agree with that of the front loudspeakers 15, 15, 15, because there is no abrupt or sharp decrease of sound pressure in the low frequency range concerning the back loudspeaker consoles 16, 16.

Relation Between Cut-off Frequency fh of the High-pass Filter and the Cut-off Frequency fc of the Console In the following, effect of the relations between the cut-off frequency fh of the high-pass filter 6 and the cut-off frequency fc of the console having a pair of loudspeakers driven in opposite phase relation, in the above-mentioned first embodiment, is discussed.

$fh \approx fc$

In the frequency range above the cut-off frequency fh of the high-pass filter, the sound radiated from respective loudspeaker are of the same sound wave amplitude and of opposite phase relation, and therefore the composite sound wave of the console has maximum sound pressure at the front part of respective loudspeakers 1 and 2 and has minimum sound pressures at the positions which are at equi-distances from centers of respective loudspeakers, that is on the line S—S which crosses the centers of the lateral side walls of the console, thereby showing dipole directivity, as already elucidated in the aforementioned description.

On the other hand, in the low frequency range under the cut-off frequency fh of the high-pass filter, the frequency characteristic of sound pressure in front of the loudspeaker 1 extends to such a low frequency range as shown by curve "c" of FIG. 2. And, by selection of the cut-off frequency fh of the high-pass filter 6 around the cut-off frequency fc of the console, the frequency range having dipole directivity can be extended to considerably low frequency without sharp decrease in low frequency range under the cut-off frequency fc. If the cut-off frequency fh were selected sufficiently lower than the cut-off frequency fc, the sharp-decrease-range or dip in spectrum of the sound pressure level due to off-setting of sound pressures of the loudspeakers 1 and 2 would arise in the frequency range which is below fc and above fh, thereby generating dip in the sound pressure frequency spectrum. On the other hand, if the cut-off frequency fh of the high-pass filter 6 were selected sufficiency higher than the cut-off frequency fc of the console, there would be no above-mentioned dip of sound pressure frequency spectrum, but the frequency range having the dipole directivity would exist only in medium high frequency range. In both of the above-mentioned cases, where the two cut-off frequencies fh and fc are sufficiently apart from each other, the characteristic are not satisfactory. Therefore, in general both cut-off frequencies fh and fc are preferably equal to each other in substance.

As a general rule, when the frequency characteristic of the loudspeakers 1 and 2 are ordinary flat ones, the cut-off frequency fh of the high-pass filter 6 should preferably be selected at the cut-off fc frequency of the console as above-mentioned, which is defined as the frequency of the sound wavelength which is twice as long as the effective distance between the two loudspeakers on the console.

$fh < fc$

In case the frequency spectrum of the loudspeakers 1 and 2 has the peak at the roll-off part in low frequency range part, the selection that the cut-off frequency fh of the high-pass filter 6 is fairly lower than the cut-off frequency fc of the console made the frequency characteristic of sound pressure as the whole console more flat.

$fh > fc$

On the other hand, when the frequency characteristic of sound pressure of the loudspeakers 1 and 2 gradually or decrease toward the very low frequency, the selection that the cut-off frequency fh of the high-pass filter 6 is fairly higher than the cut-off frequency fc of the console made the frequency characteristic of sound pressure as the whole console more flat.

As discussed above, the cut-off frequency fh of the high-pass filter should be selected, depending on difference of sound pressure frequency characteristics of the loudspeakers of the console, on the upper frequency side, on the lower frequency side or just or substantially equal to the cut-off frequency fc of the console.

The present embodiment provides satisfactory surround sound effect since the frequency range having dipole characteristic can be extended to very low frequencies by preventing decrease of sound pressure in the low frequency range.

Figure 3:
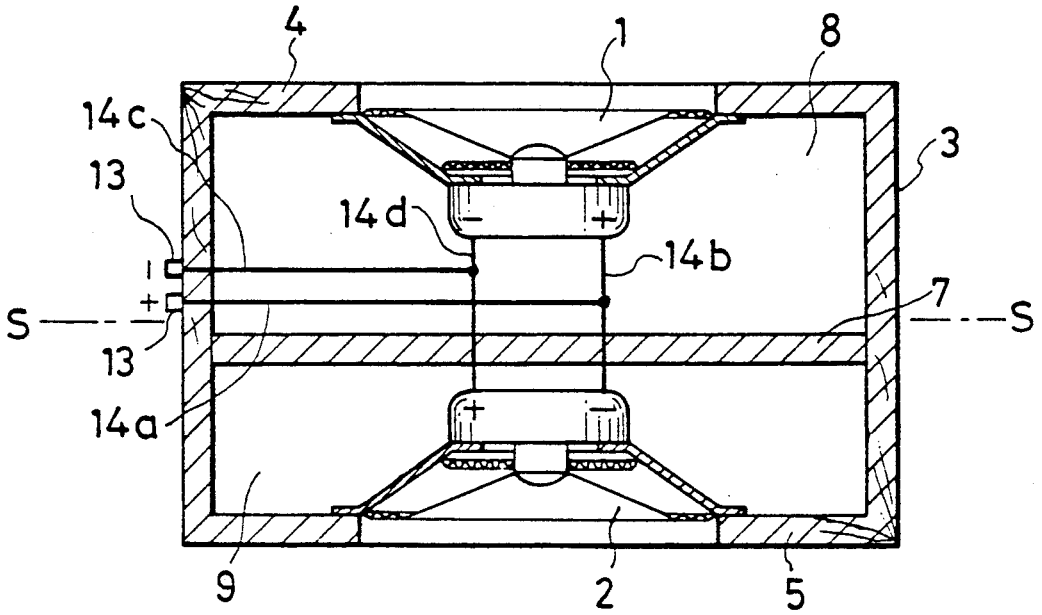
FIG. 3 is a sectional view of a loudspeaker system console of a second embodiment of the present invention.
Figure 4:
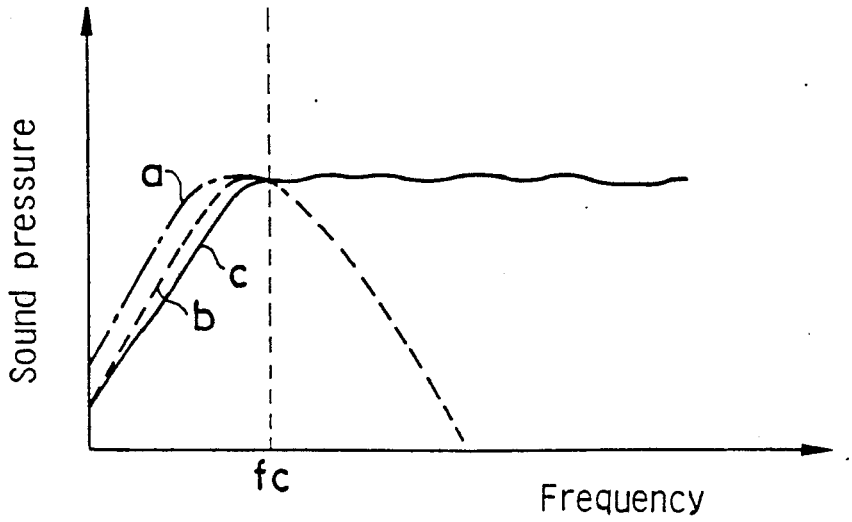
FIG. 4 is a frequency characteristic chart of the loudspeaker system of the second embodiment.

SECOND EMBODIMENT (FIG. 3 and FIG. 4)

The second embodiment of the present invention is elucidated with reference to FIG. 3 and FIG. 4. As shown in FIG. 3, a pair of loudspeakers 1 and 2 are mounted on respective baffle boards 4 and 5 which constitute both parallel walls of a console 3. The console 3 has an internal partition board 7 to form a first and a second partitioned spaces, in a manner that the first space 8 for the first loudspeaker 1 has a larger volume than a second space 9 for the second loudspeaker 2. The loudspeakers 1 and 2 have substantially equivalent sound and electric characteristics. The pair of loudspeakers 1 and 2 are connected parallelly to sound signal input terminals 13. The connection of the loudspeakers 1 and 2 are made by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, in the medium and high frequency range, wherein amplitudes of the diaphragm of the loudspeakers 1 and 2 are not influenced by stiffness of air in the partitioned spaces in the console 3, the sound waves radiated from the first loudspeaker and the second loudspeaker are of the same amplitude but opposite phase relation. Therefore, in the medium and high frequency ranges of sound, the loudspeaker system of this console shows a characteristic of dipole directivity sound pressure wherein maximum sound pressures are observed in front of each loudspeaker and minimum sound pressures are observed on the positions of equal distances from centers of both loudspeakers 1 and 2, that is on the lateral side positions which are shown by a line S—S. On the other hand, in a low frequency range which is below the cut-off frequency fc of the console 3, when the first loudspeaker 1 only be operated, it shows an overall characteristic as shown by curve "a" of FIG. 4 when an electric signal of flat spectrum is applied to through the input terminal 13 and the sound pressure is measured at the position immediately in front of the diaphragm of the first loudspeaker 1. When the second loudspeaker 2 only be operated, it shows a frequency characteristic as shown by the curve "b" of FIG. 4 against a measuring point which is immediately in front of the first loudspeaker 1. This is because the sound components of middle frequency range and high frequency range are decreased by going around of the sound wave from the second loudspeaker 2 to the measuring position immediately in front of the first loudspeaker 1; and because the closed space 9 of the second loudspeaker 2 is smaller than the closed space 8 for the first loudspeaker 1, and hence stiffness of air therein is higher than that of the space 8 thereby limiting diaphragm amplitude of the second loudspeaker 2. Thus, the loudspeakers 1 and 2 make sounds of different sound level characteristics, that is, they have different amplitude of the sound waves at the position in front of the first loudspeaker 1. And hence cancelling of the sound pressure is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 4. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2 of substantially the same electric and acoustic characteristic, a pair of multi-way loudspeaker systems may be used, wherein each multi-way loudspeaker system has plural unit loudspeakers and suitable dividing network.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

This second embodiment has, besides the advantage of the first embodiment, such advantage that there is no need of providing a high-pass filter.

Figure 5:
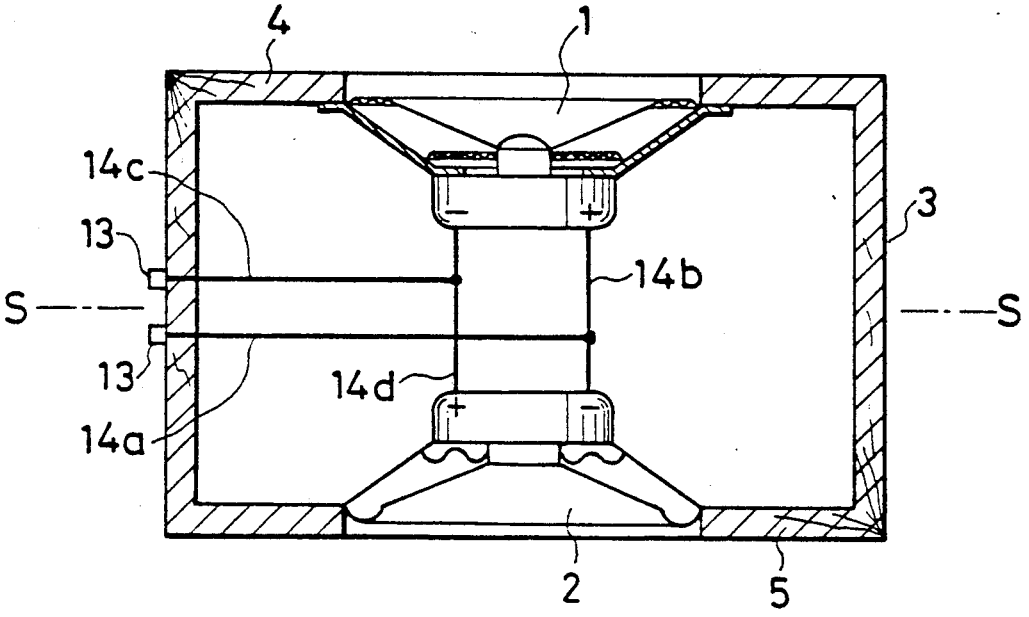
FIG. 5 is a sectional view of a loudspeaker system console of a third embodiment of the present invention.
Figure 6:
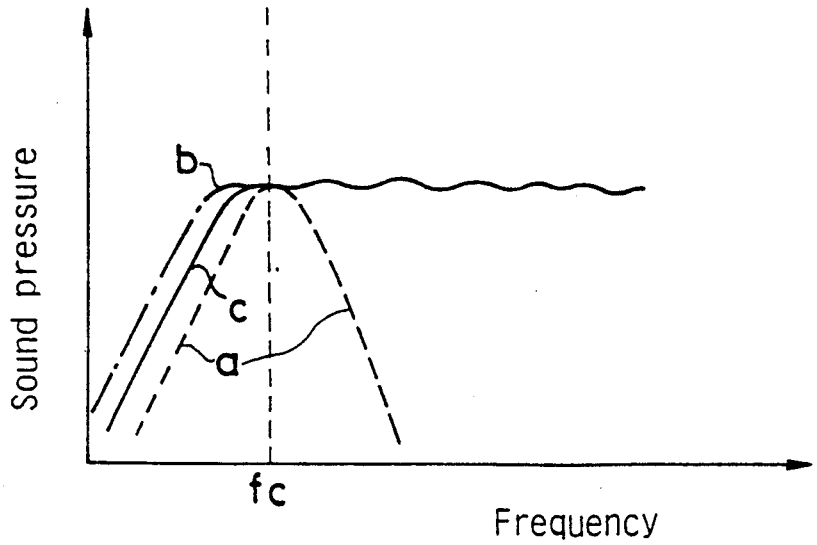
FIG. 6 is a frequency characteristic chart of the loudspeaker system of the third embodiment.

THIRD EMBODIMENT (FIG. 5 and FIG. 6)

A third embodiment of the present invention is elucidated with reference to FIG. 5 and FIG. 6. As shown in FIG. 5, a pair of loudspeakers 1 and 2 are mounted on respective baffle boards 4 and 5 which constitute both parallel walls of a console 3. The loudspeaker 1 has such vibration system that stiffness of its suspension has as strong as about twice the stiffness of the loudspeaker 2. Other characteristics of the loudspeakers 1 and 2 are substantially equivalent to each other. The pair of loudspeakers 1 and 2 are connected in parallel by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, the sound waves radiated from the first loudspeaker 1 and the second loudspeaker 2 are of substantially the same amplitude but opposite phase relation. Therefore, in the medium and high frequency ranges of sound, the loudspeaker system of this console shows a characteristic of dipole directivity sound pressure wherein maximum sound pressures are observed in front of each loudspeaker and minimum sound pressures are observed on the positions of equal distances from centers of both loudspeakers 1 and 2, that is on the lateral side positions which are shown by a line S—S. When the second loudspeaker 2 only be operated, it shows an overall characteristic as shown by curve "b" of FIG. 6 when an electric signal of flat spectrum is applied to through the input terminal 13 and the sound pressure is measured at the position immediately in front of the diaphragm of the first loudspeaker 1. As shown in FIG. 6, the curve "b" falls down in the frequency range below the cut-off frequency fc of the console. When the first loudspeaker 1 only be operated, it shows a single peak shape frequency characteristic as shown by the curve "a" of FIG. 6 against a measuring point which is immediately in front of the first loudspeaker 1. This is because the vibration amplitude in low frequencies is limited due to large stiffness of the suspension in the first loudspeaker 1, and that sound components of middle frequency range and high frequency range are decreased by going around of the sound wave from the second loudspeaker 2 to the measuring position immediately in front of the first loudspeaker 1. Thus, the loudspeakers 1 and 2 make sounds of different sound level characteristics. That is, they have different amplitude of the sound waves at the position in front of the first loudspeaker 1. And hence cancelling of the sound pressure is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 6. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2, a pair of multi-way loudspeaker systems, wherein one has larger stiffness of vibration holder than the other and each multi-way loudspeaker system has plural different unit loudspeakers and suitable dividing network.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

This third embodiment has, besides those advantages to those of the first and second embodiments, such advantages that there is no need of providing a high-pass filter nor internal partition board, and therefore the configuration is simple.

Figure 7:
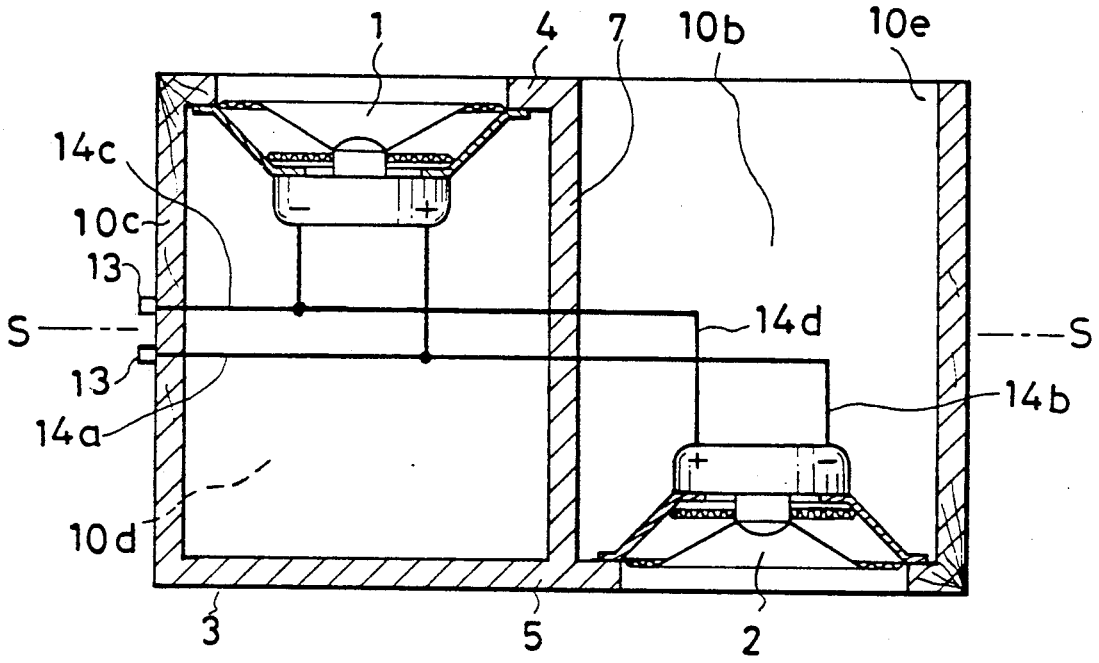
FIG. 7 is a sectional view of a loudspeaker system console of a fourth embodiment.
Figure 8:
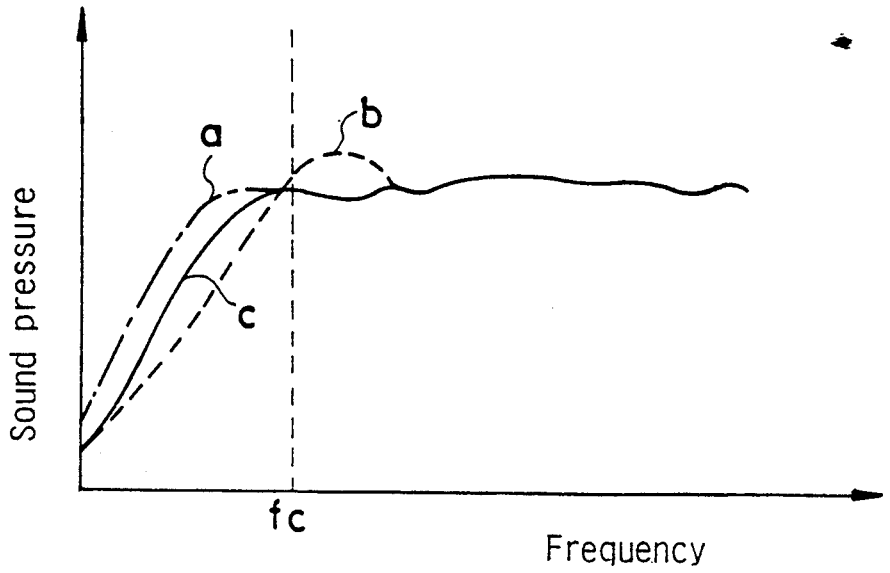
FIG. 8 is a frequency characteristic chart of the loudspeaker system of the fourth embodiment.

FOURTH EMBODIMENT (FIG. 7 and FIG. 8)

A fourth embodiment of the present invention is elucidated with reference to FIG. 7 and FIG. 8. As shown in FIG. 7, a pair of loudspeakers 1 and 2 are mounted on respective baffle boards 4 and 5 which constitute both parallel walls of a console 3. The console 3 is partitioned by a lateral partition board 7 to form a first space 10*d* which is a closed space for containing a first loudspeaker 1 and a second space 10*b* which has a back opening 10*e* to configurate a non closed space 10*b* for containing a second loudspeaker 2. The loudspeakers 1 and 2 have substantially equivalent sound and electric characteristics. The pair of loudspeakers 1 and 2 are connected by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, in the frequencies of middle and high frequency ranges wherein the amplitudes of the diaphragm receive no influence by the difference of the 10*d* and 10*b* (closed type or open type) containing the loudspeakers 1 and 2, the sound waves radiated from the first loudspeaker 1 and the second loudspeaker 2 are of the same amplitude but opposite phase relation. Therefore, in the frequencies of middle and high frequency ranges, the loudspeaker system of this console shows a characteristic of dipole directivity sound pressure wherein maximum sound pressures are observed in front of each loudspeaker and minimum sound pressures are observed on the positions of equal distances from centers of both loudspeakers 1 and 2, that is on the lateral side positions which are shown by a line S—S. On the other hand, in a low frequency range which is below the cut-off frequency fc of the console 3, when the first loudspeaker 1 contained in the closed space 10*d* only be operated, it shows an overall characteristic as shown by curve "a" of FIG. 8 at application of electric signal of flat spectrum through the input terminal 13 and the sound pressure is measured at the position immediately in front of the diaphragm of the first loudspeaker 1. As shown in FIG. 8, the curve "a" falls down in the frequency range below fc. When the second loudspeaker 2 contained in the non-closed space 10*b* only be operated, it shows a frequency characteristic as shown by the curve "b" of FIG. 8 against a measuring point which is immediately in front of the first loudspeaker 1. This is because the sound components of middle frequency range and high frequency range are decreased by going around of the sound wave from the second loudspeaker 2 to the measuring position immediately in front of the first loudspeaker 1. Thus, the loudspeakers 1 and 2 make sounds of different sound level characteristics, that is, they have different amplitude of the sound waves at the position in front of the first loudspeaker 1. And hence cancelling of the sound pressure is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 8. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2, a pair of multi-way loudspeaker systems may be used.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

Figure 9:
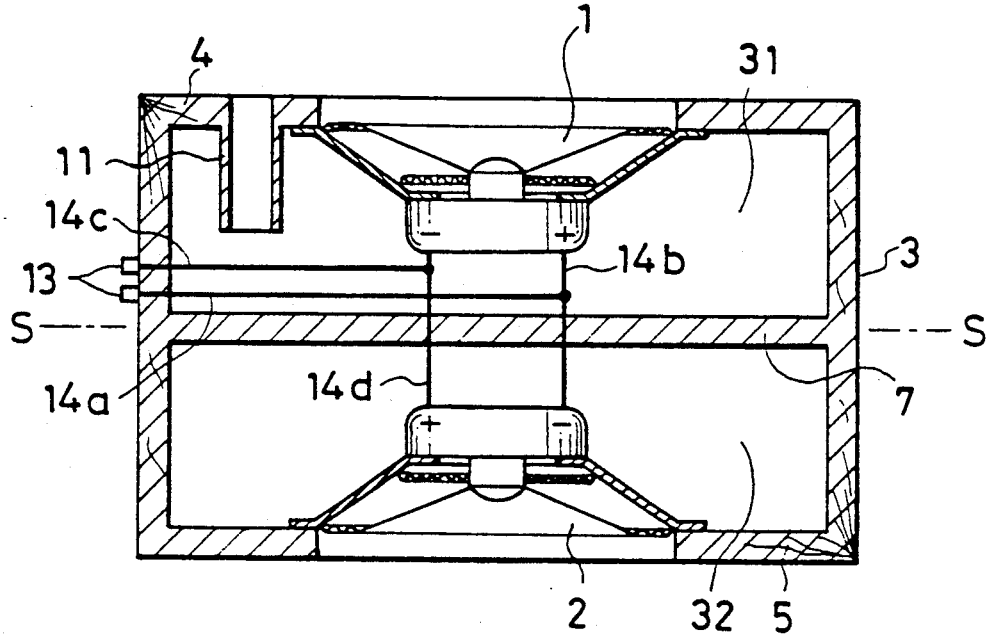
FIG. 9 is a sectional view of a loudspeaker system console of a fifth embodiment.
Figure 10:
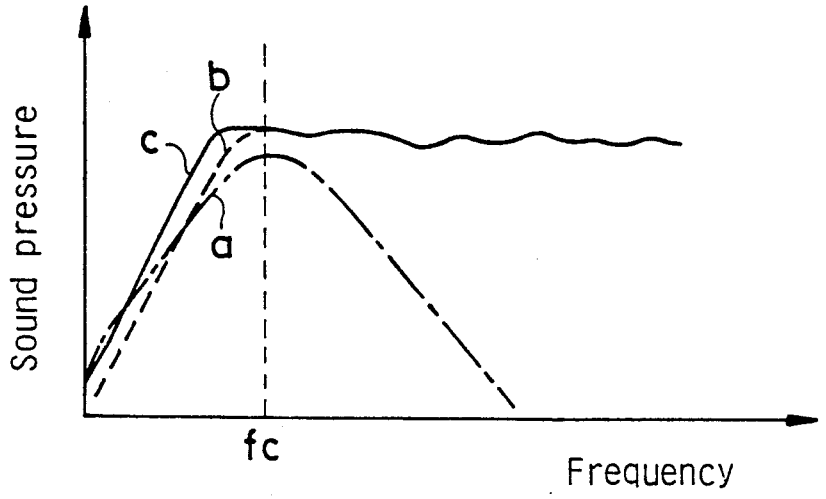
FIG. 10 is a frequency characteristic chart of the loudspeaker system of the fifth embodiment.

FIFTH EMBODIMENT (FIG. 9 and FIG. 10)

The fifth embodiment of the present invention is elucidated with reference to FIG. 9 and FIG. 10. As shown in FIG. 9, a pair of loudspeakers 1 and 2 are mounted on respective baffle boards 4 and 5 which constitute both parallel walls of a console 3. The console 3 has an internal partition board 7, in a manner that a first space 31 for the first loudspeaker 1 and a second space 32 for the second loudspeaker 2 have substantially the same volumes. The second space 32 is configurated as a closed space, and on the contrary the first space 31 is provided with a duct 11 which has an opening on the front baffle board 4 to constitute the first space 31 as a bass-reflex type resonator space. The loudspeakers 1 and 2 have substantially equivalent sound and electric characteristics. The pair of loudspeakers 1 and 2 are connected to sound signal input terminals 13. The connections of the loudspeakers 1 and 2 are made by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, in the medium and high frequency range, wherein amplitudes of the diaphragm of the loudspeakers 1 and 2 are not influenced by stiffness of air in the partitioned spaces in the console 3, the sound waves radiated from the first loudspeaker and the second loudspeaker are of the same amplitude but opposite phase relation. Therefore, in the medium and high frequency ranges of sound, the loudspeaker system of this console shows a characteristic of dipole directivity sound pressure wherein maximum sound pressures are observed in front of each loudspeaker and minimum sound pressures are observed on the positions of equal distances from centers of both loudspeakers 1 and 2, that is on the lateral side positions which are shown by a line S—S. On the other hand, in a low frequency range which is below the cut-off frequency fc of the console 3, when the second loudspeaker 2 in the closed space 32 only be operated, it shows an overall characteristic as shown by curve "a" of FIG. 10, when an electric signal of flat spectrum is applied to through the input terminal 13 and the sound pressure is measured at the position immediately in front of the diaphragm of the first loudspeaker 1. This is because the sound components of middle frequency range and high frequency range are decreased due to going around of the sound wave from the second loudspeaker 2 to the measuring position immediately in front of the first loudspeaker 1. When the first loudspeaker 1 only be operated, it shows a frequency characteristic as shown by the curve "b" of FIG. 10 against a measuring point which is immediately in front of the first loudspeaker 1, since the first loudspeaker 1 in the first space 31 operates in bass-reflex operation, and hence its sound level of low frequency component becomes higher than that of the second loudspeaker 2 contained in the closed second space 32. Thus, the loudspeakers 1 and 2 make sounds of different sound level characteristics, that is, they have different amplitude of the sound waves at the position in front of the first loudspeaker 1. And hence cancelling of the sound pressure is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 10. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2 of substantially the same electric and acoustic characteristic, a pair of multi-way loudspeaker systems may be used, wherein each multi-way loudspeaker system has plural unit loudspeaker and suitable dividing network.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

Figure 11:
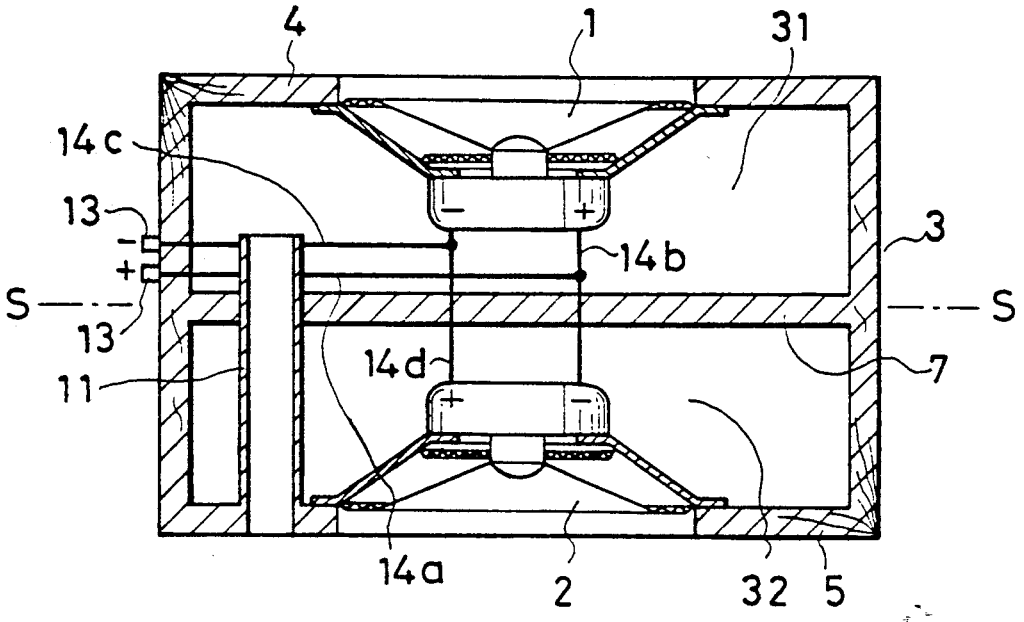
FIG. 11 is a sectional view of a loudspeaker system console of a sixth embodiment.
Figure 12:
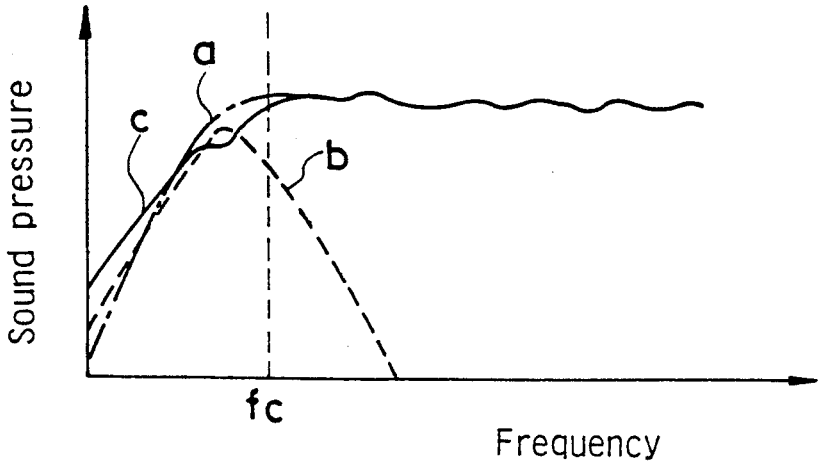
FIG. 12 is a frequency characteristic chart of the loudspeaker system of the sixth embodiment.

SIXTH EMBODIMENT (FIG. 11 and FIG. 12)

The sixth embodiment of the present invention is elucidated with reference to FIG. 11 and FIG. 12. As shown in FIG. 11, a pair of loudspeakers 1 and 2 are mounted on respective baffle boards 4 and 5 which constitute both parallel walls of a console 3. The console 3 has an internal partition board 7, in a manner that a first space 31 for the first loudspeaker 1 and a second space 32 for the second loudspeaker 2 have substantially the same volumes. The second space 32 is configurated as a closed space, and on the contrary the first space 31 is connected to a duct 11 which penetrates said partition board 7 and has an outside opening on the back baffle board 5, to constitute the first space 31 as a bass-reflex type resonator space. The loudspeakers 1 and 2 have substantially equivalent sound and electric characteristics. The pair of loudspeakers 1 and 2 are connected through a high-pass filter 6 and directly to sound signal input terminals 13, respectively. The connections of the loudspeakers 1 and 2 are made by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, in the medium and high frequency range, wherein amplitudes of the diaphragm of the loudspeakers 1 and 2 are not influenced by difference of spaces (closed type and bass-reflex type) in the console 3, the sound waves radiated from the first loudspeaker and the second loudspeaker are of the same amplitude but opposite phase relation. Therefore, in the medium and high frequency ranges of sound, the speaker system of this console shows a characteristic of dipole directivity sound pressure wherein maximum sound pressures are observed in front of each loudspeaker and minimum sound pressures are observed on the positions of equal distances from centers of both loudspeakers 1 and 2, that is on the lateral side positions which are shown by a line S—S. On the other hand, in a low frequency range which is below the cut-off frequency fc of the console 3, when the second loudspeaker 2 in the closed space 32 only be operated, it shows an overall characteristic as shown by curve "b" of FIG. 12, when an electric signal of flat spectrum is applied to through the input terminal 13 and the sound pressure is measured at the position immediately in front of the diaphragm of the first loudspeaker 1. This is because the sound components of middle frequency range and high frequency range are decreased due to going around of the sound wave from the second loudspeaker 2 to the measuring position immediately in front of the first loudspeaker 1. When the first loudspeaker 1 only be operated, it shows a frequency characteristic as shown by the curve "a" of FIG. 12 against a measuring point which is immediately in front of the first loudspeaker 1, since the first loudspeaker 1 in the first space 31 operates in bass-reflex operation, and hence its sound level of low frequency component becomes higher than that of the second loudspeaker 2 contained in the closed second space 32. Thus, the loudspeakers 1 and 2 make sounds of different sound level characteristics, that is, they have different amplitude of the sound waves at the position in front of the first loudspeaker 1. And hence cancelling of the sound pressure is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 12. In other words, the embodiment in accordance with the present invention does not show excessively steep decrease of sound pressure below a cut-off frequency fc as has been seen in the conventional dipole type loudspeaker system.

In place of the above-mentioned simple first and the second loudspeakers 1 and 2 of substantially the same electric and acoustic characteristic, a pair of multi-way loudspeaker systems may be used, wherein each multi-way loudspeaker system has plural unit loudspeaker and suitable dividing network.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

Figure 13:
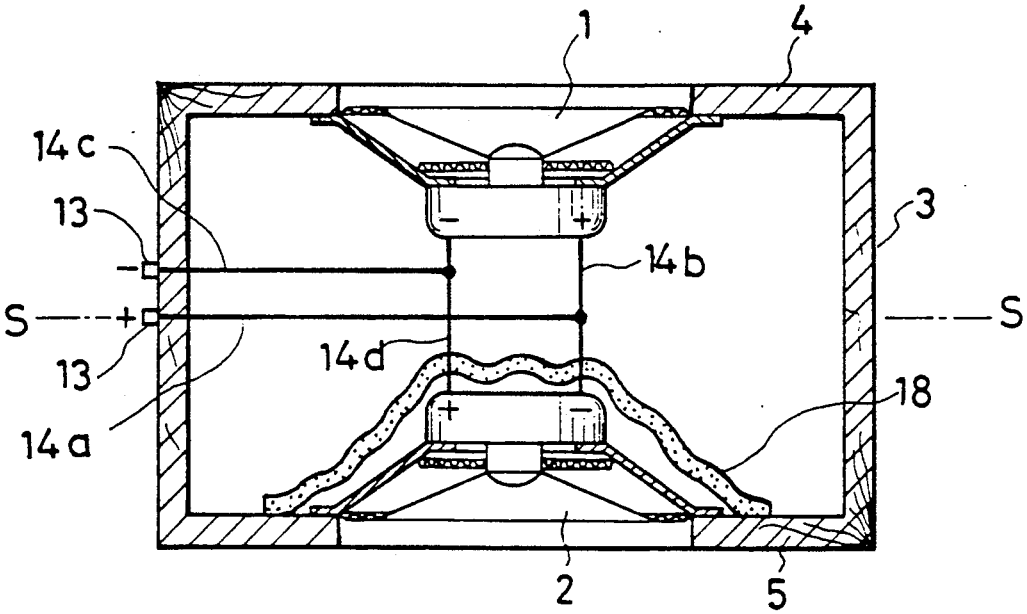
FIG. 13 is a sectional view of a loudspeaker system console of a seventh embodiment.
Figure 14:
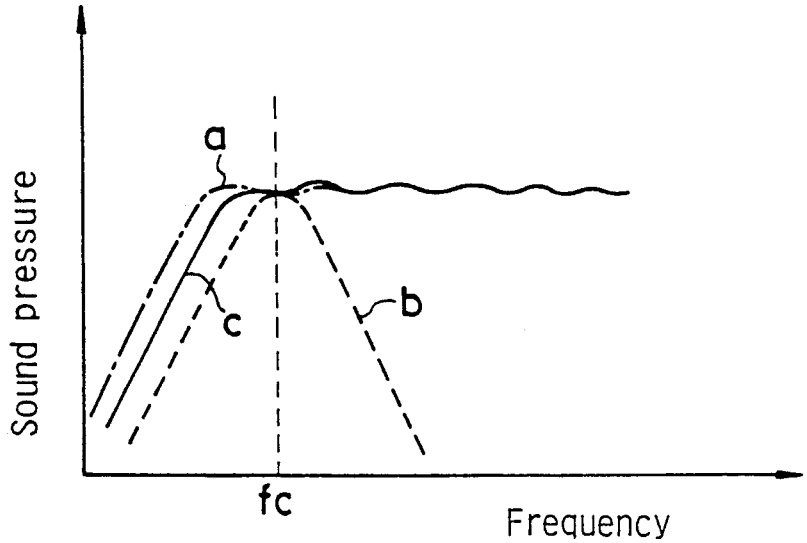
FIG. 14 is a frequency characteristic chart of the loudspeaker system of the seventh embodiment.
Figure 13A:
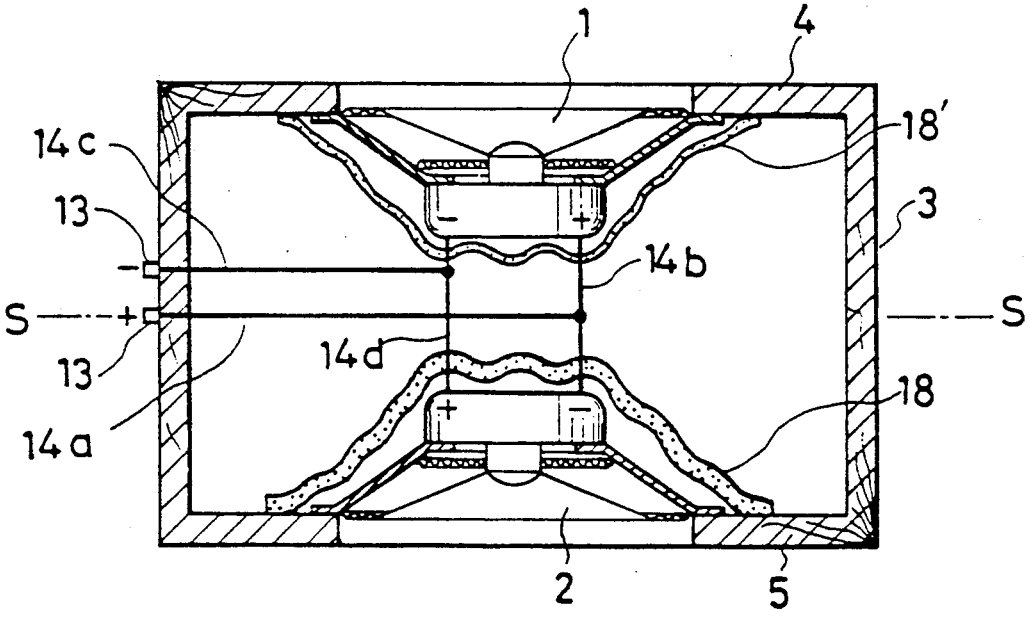
FIG. 13A is a sectional view of a loudspeaker system console of a seventh embodiment.

SEVENTH EMBODIMENT (FIG. 13 and FIG. 14)

A seventh embodiment of the present invention is elucidated with reference to FIG. 13 and FIG. 14. As shown in FIG. 13, a pair of loudspeakers 1 and 2 are mounted on respective baffle boards 4 and 5 which constitute both parallel walls of a console 3. Inside the space in the console 3, the back side of the second loudspeaker 2 only is wrapped by a sound absorbing thick web 18, such as, felt, glass-wool, dense plastic sponge, foamed rubber, and the like. Electric and acoustic characteristics of the loudspeakers 1 and 2 per se are substantially equivalent to each other. The pair of loudspeakers 1 and 2 are connected in parallel by means of internal connecting wires 14*a*, 14*b*, 14*c*, 14*d* in a manner that they operate in opposite phase relations to each other. The opposite phase relation is such that, for instance, when the diaphragm of the front loudspeaker 1 is driven outward of the front baffle board 4, the diaphragm of the second loudspeaker 2 is driven inward of the back baffle board 5.

According to the above-mentioned configuration, in the medium and high frequency ranges of sound, wherein the amplitude of the diaphragm is not influenced with the wrapping with sound absorbing web 18, the sound waves radiated from the first loudspeaker 1 and the second loudspeaker 2 are of substantially the same amplitude but opposite phase relation. Therefore, the loudspeaker system of this console 3 shows a sound pressure characteristic of dipole directivity wherein maximum sound pressures are observed in front of each loudspeaker and minimum sound pressures are observed on the positions of equal distances from centers of both loudspeakers 1 and 2, namely on the lateral side positions which are shown by a line S—S. On the other hand, in the low frequency range, when the first loudspeaker 1 only be operated, it shows an overall characteristic as shown by curve "a" of FIG. 14 when an electric signal of flat spectrum is applied to through the input terminal 13 and the sound pressure is measured at the position immediately in front of the diaphragm of the first loudspeaker 1. As shown in FIG. 14, the curve "a" falls down in the frequency range below the cut-off frequency fc of the console. When the second loudspeaker 2 only be operated, it shows a single peak shape frequency characteristic as shown by the curve "b" of FIG. 14 against a measuring point which is immediately in front of the first loudspeaker 1. This is because the vibration amplitude in low frequencies is limited due to a large resistance of air flow through the sound absorbing web 18 wrapping the back side of the second loudspeaker 2, in contrast to no air resistance on the first loudspeaker 1. Thus, the loudspeakers 1 and 2 make sounds of different sound level characteristics. That is, they have different amplitude of the sound waves at the position in front of the first loudspeaker 1. Accordingly, in such low frequency range, because of the difference of the amplitude level of the sound pressure, the cancelling of the sound pressure opposite phase sound is not completely made. Therefore, overall sound pressure frequency characteristic of the console with two loudspeakers 1 and 2 when both are driven in the opposite phase relation and measured at a position in front of the first loudspeaker, becomes to extend below the cut-off frequency fc as shown by curve "c" in FIG. 14. In other words, the embodiment in accordance with the present invention does not show excessively steep decrease of sound pressure below a cut-off frequency fc as has been seen in the conventional dipole type loudspeaker system.

In place of wrapping the back side of only one loudspeaker Z with the sound absorbing web 18, a modification may be such that the back sides of both loudspeakers 1 and 2 are wrapped with sound absorbing webs of much different sound absorbing abilities or sound treating abilities, so that a prominent difference on amplitude of sound wave in the low frequency range is produced.

In place of the above-mentioned simple first and the second loudspeakers 1 and 2, a pair of multi-way loudspeaker systems, wherein one has larger stiffness of vibration holder than the other and each multi-way loudspeaker system has plural different unit loudspeakers and suitable dividing network.

The directivity characteristic as a back loudspeaker console 16 of a surround sound system e.g. of FIG. 15 with respect to frequency range above the cut-off frequency fc is a dipole directivity. Therefore, around at the position of the listener 17, the sound pressure of direct sound from the back loudspeaker console 16 is minimum for the frequencies above the cut-off frequency fc, and only the indirect sound reflected by the walls of the listening room reaches the ears of the listener. Thus, sufficient surround sound effect for the listener 17 is obtainable.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A loudspeaker system comprising:

a loudspeaker console having a front baffle board and a back baffle board which are disposed in substantial parallelism to each other, a pair of loudspeakers which are mounted on respective baffle boards and operate with substantially the same characteristic with each other above a predetermined cut-off frequency but radiate sound of different level under said predetermined cut-off frequency, and a driving circuit for driving said two loudspeakers in each-other opposite phase relation.

2. A loudspeaker system in accordance with claim 1 wherein one of said pair of loudspeaker is connected with a high-pass filter which has a predetermined cut-off frequency.

3. A loudspeaker system in accordance with claim 2 wherein said predetermined cut-off frequency of said filter is selected substantially at a frequency whose wavelength is a half (½) of effective distance between said two loudspeakers.

4. A loudspeaker system in accordance with claim 1 wherein said loudspeaker console has an internal partition board to divide inside space of said loudspeaker console into a larger partitioned space containing a first one of said pair of loudspeakers and a smaller partitioned space containing a second one of said pair of loudspeakers.

5. A loudspeaker system in accordance with claim 1 wherein one of said pair of loudspeakers has diaphragm holding means of a twice or larger stiffness than that of the diaphragm holding means of the other loudspeaker.

6. A loudspeaker system in accordance with claim 1 wherein said loudspeaker console has a partition board to divide inside space of said loudspeaker console into a first cavity of closed space and a second cavity of an open type whose back part is open.

7. A loudspeaker system in accordance with claim 1 wherein said loudspeaker console has a partition board to divide inside space of said loudspeaker console into a first cavity and a second cavity and said first baffle board has a duct connected to the inside of said second cavity thereby making said first cavity a bass-reflex type cavity.

8. A loudspeaker system in accordance with claim 1 wherein said loudspeaker console has a partition board to divide inside space of said loudspeaker console into a first cavity and a second cavity and said first cavity is connected outside through a duct which penetrate through said partition board, inside space of said second cavity and said second baffle board.

9. A loudspeaker system in accordance with claim 1 wherein back side of either one loudspeaker is wrapped by a sound absorbing web.

10. A loudspeaker system in accordance with claim 1 wherein back side of the pair of loudspeakers are wrapped by sound absorbing webs of sufficiently different sound absorbing ability.

* * * * *